US005671813A

United States Patent [19]

Lima

[11] Patent Number: 5,671,813

[45] Date of Patent: Sep. 30, 1997

[54] METHOD AND APPARATUS FOR INTERMITTENT PRODUCTION OF OIL WITH A MECHANICAL INTERFACE

[75] Inventor: Paulo César Ribeiro Lima, Rio de Janeiro, Brazil

[73] Assignee: Petroleo Brasileiro S.A. - Petrobras, Rio de Janeiro, Brazil

[21] Appl. No.: 542,324

[22] Filed: Oct. 12, 1995

[30] Foreign Application Priority Data

Oct. 14, 1994 [BR] Brazil ..... 9404096-6

[51] Int. Cl.[6] ..... E21B 43/16

[52] U.S. Cl. ..... 166/372; 166/68; 417/143

[58] Field of Search ..... 166/372, 68, 70; 417/137, 143, 144

[56] References Cited

U.S. PATENT DOCUMENTS

| | | | |
|---|---|---|---|
| 649,326 | 5/1900 | Losure | 166/68 X |
| 2,896,547 | 7/1959 | Franey et al. | 417/143 |
| 3,372,753 | 3/1968 | Tuttle | 166/68 X |
| 3,894,814 | 7/1975 | Morgan | 417/413 X |
| 5,006,046 | 4/1991 | Buckman et al. | 417/54 |
| 5,211,242 | 5/1993 | Coleman et al. | 166/372 |
| 5,450,902 | 9/1995 | Matthews | 166/372 X |
| 5,488,993 | 2/1996 | Hershberger | 166/372 |

OTHER PUBLICATIONS

The Technology of Artificial Lift Methods, Chapter 8, "Other methods of artificial lift", pp. 519–524, Kermit E. Brown, The University of Tulsa, Petroleum Publishing Co., Tulsa, 1980.

*Primary Examiner*—Hoang C. Dang
*Attorney, Agent, or Firm*—Sughrue, Mion, Zinn, Macpeak & Seas

[57] ABSTRACT

Two production strings extend downwardly from a well head of an oil well to a point adjacent a producing region. Lower ends of the two production strings are connected by a coupling which allows a mechanical interface launched adjacent the well head of one of the production strings to descend along the production string through the coupling and upwardly through the other production string to displace oil from the production strings to a surge tank. High pressure gas is utilized to move the mechanical interface through the production strings and suitable valves are provided for controlling the flow of gas and oil through the production strings.

8 Claims, 5 Drawing Sheets

METHOD AND APPARATUS FOR INTERMITTENT PRODUCTION OF OIL WITH A MECHANICAL INTERFACE

FIELD OF THE INVENTION

This invention refers to a method and an apparatus to promote the artificial lift of oil in oil producing wells.

BACKGROUND OF THE INVENTION

The purpose of the invention is to promote the artificial lift of the oil that accumulates in the production string of oil wells.

Two interconnected production strings are utilized plus one extremely flexible mechanical interface, which is responsible for removing the oil that accumulates in the production strings pushing it to the surface and consequently reducing the hydrostatic pressure that the hydrostatic head exerts upon the producing region.

PRIOR ART

After an oil well has been completed the oil flow to the surface will only occur if the reservoir pressure is sufficient to overcome the counterpressure exerted by the head of the oil accumulated in the production string.

In case the reservoir pressure is not sufficient to overcome this counterpressure it becomes then necessary to utilize some artificial lifting method in order to flow off the oil to the surface. Some of these methods are mechanical pumping systems, down hole centrifugal pumping systems and progressive cavity pumping systems.

A common feature shared by all these systems is that they require the supply of some kind of energy to drive the pumping equipment, normally located around the producing region, which establishes the need to utilize some physical means for supplying energy, and this may be an electrical cable to feed the engine of the submersed centrifugal pump, or a string of mechanical rods for driving the sub-surface pump or the progressive cavity pump. All of these systems share the common feature that they consist of a great number of components prone to failure.

A widely employed method is pneumatic pumping, known by those skilled in the art as "gas lift"; which consists basically in injecting gas into the annular space that exists between the production strings and the well casing. Gas is injected into the production string by means of special valves with the purpose of gasifying the oil. This gasification reduces the gas specific weight and facilitates the flow off to the surface.

Basically there are two "gas lift" systems which are called "continuous gas lift" and "intermittent gas lift". In the "continuous gas lift", as the very name suggests, gas is injected continually into the annular space until it reaches a valve at the bottom of the well which allows the gas to be injected into the interior of the production string.

In the "intermittent gas lift", contrary to the previous one, the well is allowed for some time to produce without injecting gas. Next, gas is injected into the annular space at quite high pressures. Special valves installed in the "gas lift" mandrel allow the gas to be injected into the production string thus causing the effect of pumping the oil to the surface.

In spite of some advantages the artificial gas lifting methods have some serious inconveniences, such as, for instance, the slippage between the gaseous and liquid phases, a situation in which the gas flows to the surface and the oil remains in the interior of the well, a very common fact in wells that produce highly viscous oil.

Another serious inconvenience is that it is difficult to apply such a technique in directional wells where the inclination of the well may facilitate the formation of gas segregation zones which may even make the utilization of the method unfeasible. The great depth of the producing region is another well feature which hampers the utilization of the "gas lift" method.

Another serious inconvenience of the artificial gas lift methods is the increase of the pressure at the bottom which is a further limiting factor in oil production.

Yet another solution for the problem is the utilization of the method known as "plunger lift"; it consists basically of using a kind of plunger to cause the lifting of the oil contained in the production string.

Gas is injected into the bottom of the well and this causes the plunger to rise to the well head. In moving upward the plunger pushes the oil accumulated in the string and thus causes the oil to flow off.

Although this method presents good results a serious inconvenience it has is that it is necessary to shut the valves existing at the surface at the moment the plunger reaches its highest position so as to make it possible for it to descend to the bottom of the well again to start a new cycle; this causes interruption in the production and limits the utilization of the method to wells at small depths inasmuch as in deeper wells the waiting time for the plunger to move down would be very long.

Another method utilizes synthetic rubber spheres to cause the flowing off of the oil accumulated in the production string. This method, known to experts as the "sphere pump gas lift system", basically consists in the utilization of a second string called pressurizing string of identical diameter as that of the production string. This second string is utilized to move the spheres down. The two strings are interconnected in a zone close to the producing region.

This method has some inconveniences and the main one is the risk that the spheres may become stuck or arrested within the strings. Another drawback is due to the fact that the efficiency of the method depends basically on the sealing ability of the spheres which, in view of their very geometry, does not guarantee a perfect seal.

A further problem to be considered is the high cost of the spheres which wear out within a short time as well as the complexity of the facilities at the surface and at the sub-surface.

This invention proposes a method and an apparatus that solves all of the inconveniences described above.

SUMMARY OF THE INVENTION

The present invention is directed to a new and improved apparatus for intermittent oil production using a mechanical interface wherein the apparatus comprises at least two production strings extending from a well head to a coupling disposed down a well adjacent a producing region, said coupling interconnecting said two production strings and a short production string which extends further down the well and which is provided with a check valve at a lower end thereof, a gas source for supplying high pressure gas and a surge tank for receiving oil disposed adjacent said well head, gas feeding valves connected between said gas source and said production string for selectively providing high pressure gas to either production string, valve means for allowing introduction of at least one mechanical interface into launching/receiving devices connected to upper ends of said production strings, bypass means connected between each production string at a point downstream of each launching/receiving device for equalizing upstream and downstream pressure when said mechanical interface passes said point, check valves connected in said bypass means for permitting flow of gas through each bypass means only in one direction, production valves disposed in production lines connected between said production strings and said surge tank for allowing flow of oil from said production strings to said surge tank and a gas/liquid interface sensor means mounted on said production line leading to said surge tank for detecting when outflow to said surge tank is composed primarily of injected gas and for commanding closing of said gas feeding valves and opening of said production valves.

BRIEF DESCRIPTION OF THE DRAWINGS

The present invention will be better described on the basis of the accompanying drawings, namely.

DESCRIPTION OF THE INVENTION

Before describing the invention reference will be made to FIGS. 1*a*, 1*b* and 1*c* where one sees the schematic representation of the conventional application of the "sphere pump gas lift" method.

The two swings (41) and (42) are of the same internal diameter. String (42), called the injection string, is designed for introducing the spheres and for injecting gas. String (41), called production string, is intended for draining off the oil produced as well as for the discharging of the spheres.

Figure 1C:
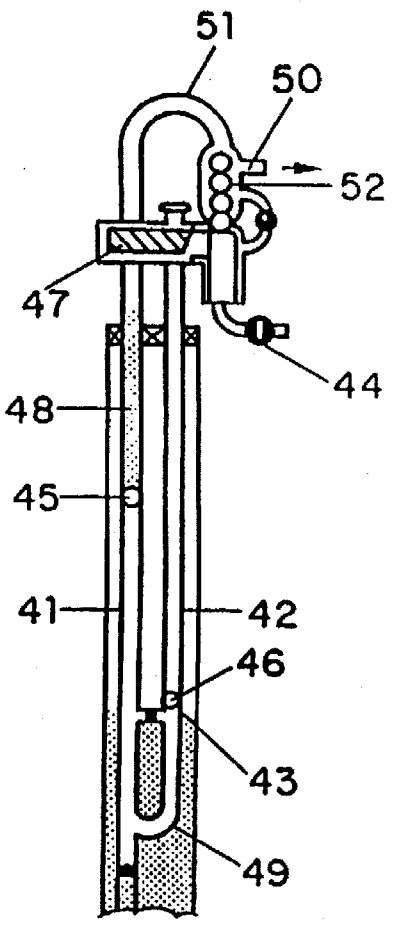
FIG. 1c PRIOR ART
FIGS. 1*a*, 1*b* and 1*c* are a schematic representation of a completed well with the apparatus to apply the conventional method known as "sphere pump gas lift".
Figure 1B:
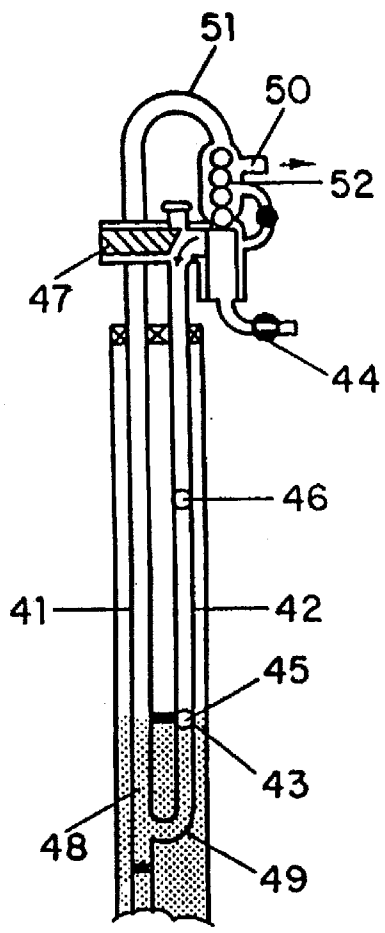
FIG. 1b PRIOR ART
Figure 1A:
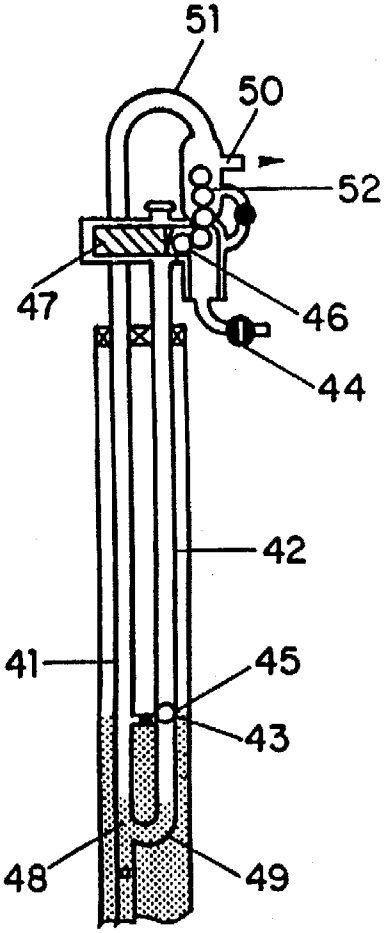
FIG. 1a PRIOR ART

In FIG. 1A one sees a sphere (45) that has been previously introduced into the injection string resting upon a restriction (43) located close to the producing region The portion of the injection string (42) between restriction (43) and the surface contains gas at a pressure sufficient to cause the oil to rise, yet not sufficient to force sphere (45) through restriction (43). Pressure in the production string (41) at this moment is equivalent to the separation pressure, inasmuch as valve (47) located at the surface is open.

At a given moment gas injection valve (44) opens, as shown in FIG. 1B, allowing the gas to pass into injection siring (42) and also causing valve (47) to close.

At such moment another sphere (46) is freed by sphere launching/receiving device (52), located in the well head; it is led into the interior of injection string (42) by the gas flow and also by gravity, until it places itself on top of sphere (45).

The pressure on sphere (45) increases continuously until it reaches a value sufficient to force its passage through restriction (43), taking it toward dogleg (49) where hydrostatic head (48) has already accumulated. As sphere (45) passes through restriction (43), the gas volume that is retained by the latter also eventually passes through restriction (43).

Gas injection valve (44) closes next, as can be seen in FIG. 1C, which allows valve (47) to open. The gas volume released into injection string (42) by the opening of the injection valve (44) is retained, because sphere (46) prevents it from passing through restriction (43). This gas volume retained in injection string (42) will be responsible for the lifting of the oil in the next cycle.

At the same time, expansion of the gas freed by the passage of sphere (45) through restriction (43) keeps on pushing sphere (45) and, consequently, hydrostatic head (48) too, taking it to the surface.

The dogleg (51) is designed so as to enable the produced oil to flow out through terminal (50) and sphere (45) to return to the sphere launching/receiving device (52).

This method has several inconveniences, "inter alia" the equipment involved is highly complex and the consumption of spheres is excessive, in addition to the great risk that these spheres get stuck.

The invention which is the subject of the present specification and claims proposes the adoption of two strings to lift the oil and which are interconnected at the bottom of the well. These strings may be of different diameters.

At least one mechanical interface runs along the two strings, either in one direction or in the other, pushed by the gas pressure, thus causing the oil to flow out to the surface.

Figure 2:
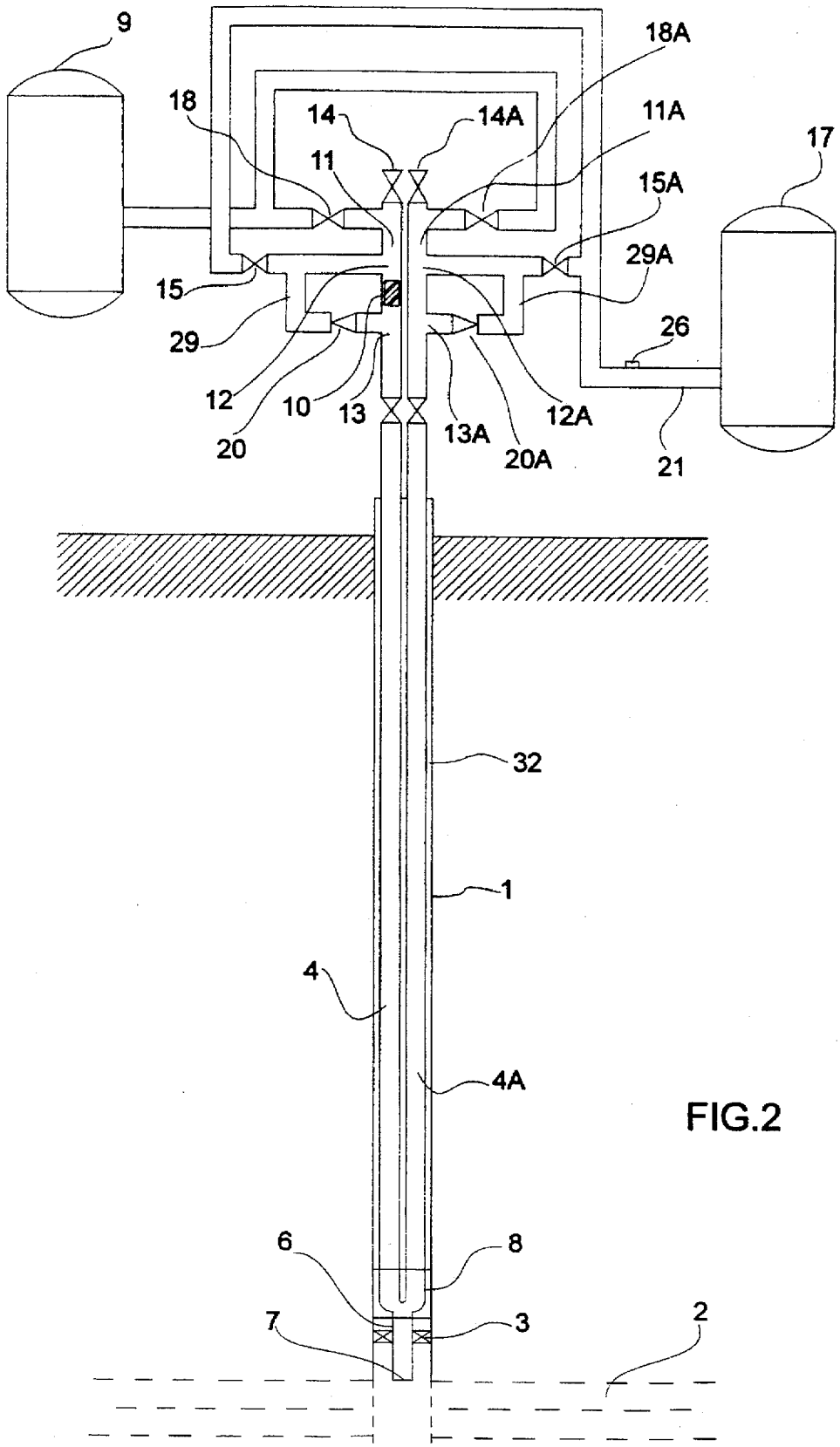
FIG. 2 is a schematic representation of how to apply the method and of the apparatus which are the subject of this invention in a completed oil well with a packer located just a little above the producing region.

FIG. 2 shows the distribution of the equipment for the application of the method which is the subject of this invention in a completed oil well with packer(3) located just above producing region (2).

Two production strings (4, 4A) can be seen; they stretch from the well head to the joint (8); this is the item responsible for the interconnection of the production strings and the short production tubing (6).

At the lower end of short production tubing (6) one can see the presence of a check valve (7). A packer (3) is responsible for sealing annular space (32) off. This packer (3) is located in short string (6) in a place just above the producing region (2).

As a consequence of the utilization of two production strings, several surface components are utilized pairwise, which means to say that certain components that appear in one of the portions interconnected with one of the strings shall have an equivalent in the other portion interconnected with the other tubing, both components performing one same function.

These common components will appear in the text identified by the same reference number, one of them always with the letter "A" added, just as it was done with the two strings (4, 4A). Thus the surface components that are located in the portion interconnected with string (4A) and having their equivalent in the other portion interconnected with a string (4) are going to be identified by one same number plus the letter "A" added.

One can then see, still referring to FIG. 2, that there are two launchers/receivers (11, 11A) with their respective valves (14, 14A), two derivations or bypasses (29, 29A) with their respective check valves (20, 20A), two production valves (15, 15A) and two gas feeding valves (18, 18A).

Gas source (9) is responsible for the high pressure gas supply to be injected into the strings. Oil produced by the production strings is taken by surge line (21) to the surging vessel (17). One can further see the presence of a sensor of the liquid/gas interface (26) installed at the surging line (21). This sensor has several quite important functions that are going to be clearly perceived in the course of this description.

The method which is the subject of this invention begins with the opening of one of the valves (14 or 14A), of the launching/receiving devices (11 or 11A), so as to enable the introduction of at least one mechanical interface (10) into the chosen launching/receiving device and this mechanical interface (10) must be positioned between points (12 or 12A) and (13 or 13A) of the derivation (29 or 29A), as shown in FIG. 2.

Mechanical interface (10) must be made of a material that makes it very flexible in order to facilitate the displacement of same through the production strings.

Next production valves (15) and (15A) are opened whilst gas feeding valves (18) and (18A) are close. This procedure aims at accumulating oil in production strings (4) and (4A).

After a previously established period, mechanical interface (10) is launched. For this, either one of production valves (15 or 15A) is closed and either one of gas feeding valves (18 or 18A) is opened; they must be obligatorily the ones installed in the same portion where mechanical interface (10) was introduced Thus, in case the latter has been introduced in launcher/receiver (11), as shown in FIG. 2, production valve (15) must be closed and gas feeding valve (18) must be opened Inasmuch as the pressure of the gas coming from gas source (9) is higher than the pressure of the oil existing in production strings (4, 4A), mechanical interface (10) is pushed by the gas into the interior of the production strings interconnected to the portion where it has been introduced, since retention valve (20 or 20A) located in bypass (29 or 29A) blocks off the passing of the gas, preventing by pass of the flow through this route.

Pushed by the gas, mechanical interface (10) descends along the whole of production string (4 or 4A) until it reaches coupling (8); it then initiates the rise through the other production string (4A or 4) and or juction causes the displacement to the surface of the oil head accumulated in the production strings. Production line (21) leads the emerging oil flow from the production strings into surging vessel (17).

The upward movement of mechanical interface (10) is going to be interrupted right after its passage through point (13A or 13), because at this very moment the gas flow starts flowing through bypass (29A or 29); this causes the upstream and the downstream pressure of mechanical interface (10) to become equal; the mechanical interface will then halt at launching/receiving device (11A or 11) located between points (12A or 12) and (13A or 13).

A liquid/gas interface sensor (26) installed in production line (21) perceives the exact moment at which the flowout becomes only injected gas. At such moment this sensor commands the closure of gas feeding valve (18 or 18A) that was opened at the beginning of the operation and thus interrupts the gas flow.

Sensor (26) also enables the opening of the production valve (15 or 15A) that was closed in the initial operation phase and thus enables the beginning of a new filling cycle of production strings (4 and 4A).

After the mount of oil has reached the adequate level in production strings (4, 4A), a new cycle of passage of mechanical interface (10) through production strings (4, 4A) can begin, now in the opposite direction. Along the new route, "mutatis mutandis", the same operations previously described must be performed, i.e. if in the preceding route production valve (15) was closed, in the new route valve (15A) must be closed and so forth, in order to proceed with the operations normally.

Figure 3:
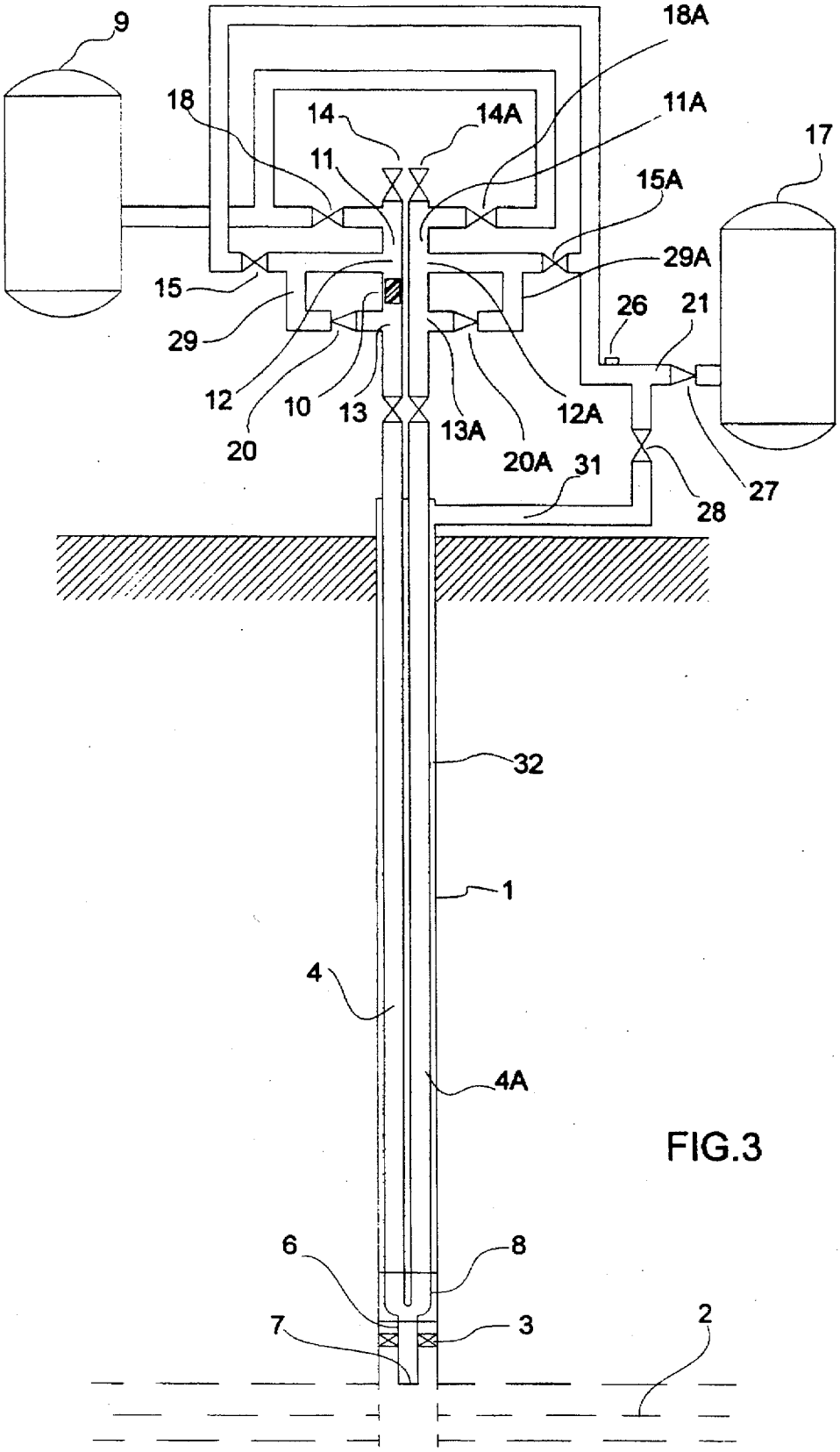
FIG. 3 is a schematic representation of the method and of the apparatus which are the subject of this invention in an oil well by means of the utilization of a packer located just a little above the producing region and the utilization of a line discharging gas into the annular space.

If one wishes to prevent the gas remaining in production strings (4, 4A) after the performance of each lifting cycle from exerting a counterpressure that would impair the filling of these tubings, one might utilize a line for gas discharge (31) in order to interconnect production line (21) with annular space (32) of the well, so as to enable the discharge of the gas accumulated in the production tubing (4, 4A) and in production line (21) into annular space (32), as shown in FIG. 3.

A discharge control valve (28) located at gas discharge line (31) and also controlled by sensor (26) monitors the gas discharge flow into annular space (32). A check valve (27) prevents a possible reflux from surge vessel (17) and from production line (21) into annular space (32).

Figure 4:
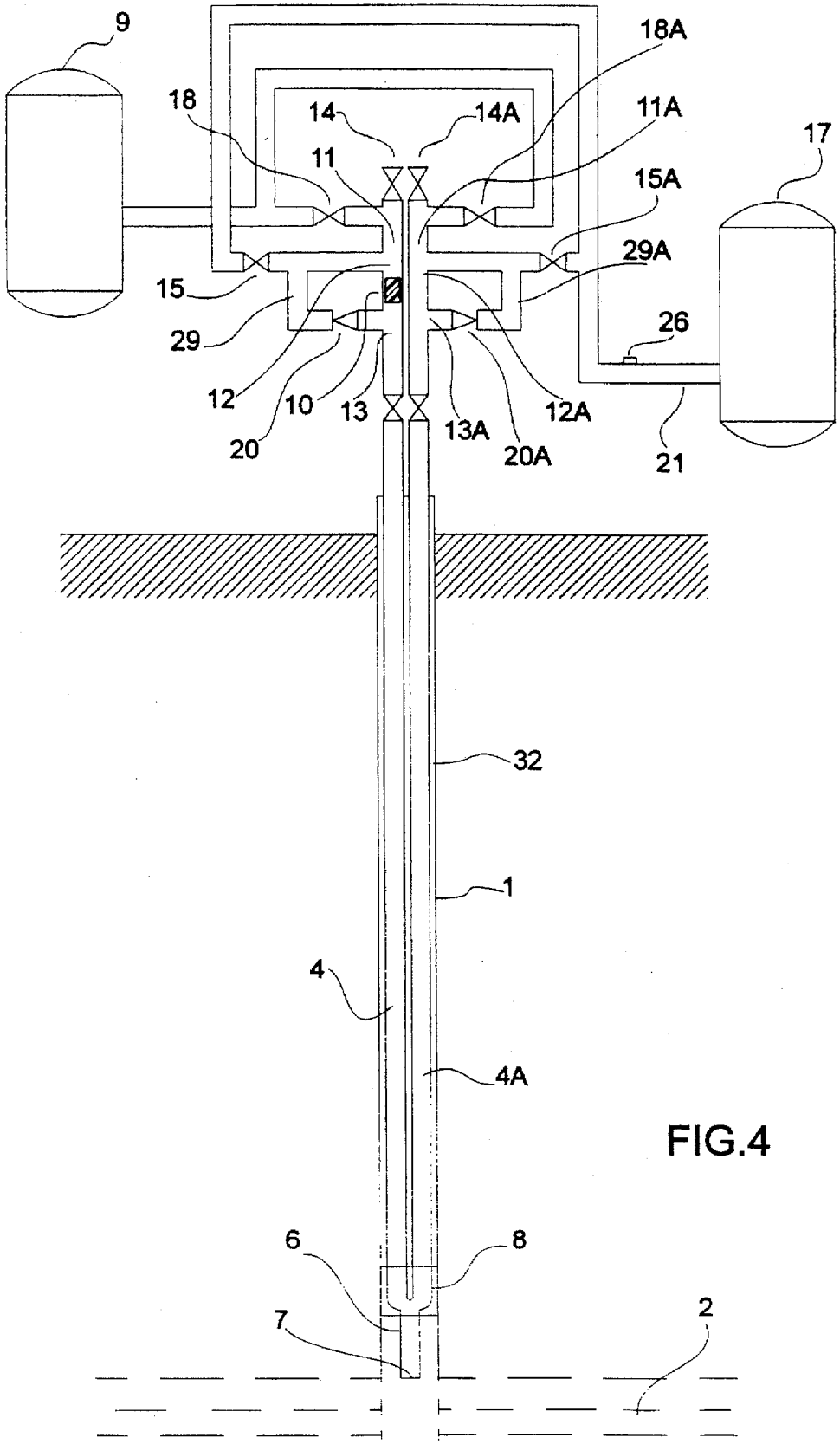
FIG. 4 is a schematic representation of the application of the method and of the apparatus which are the subject of this invention in a completed oil well without using a packer.
Figure 5:
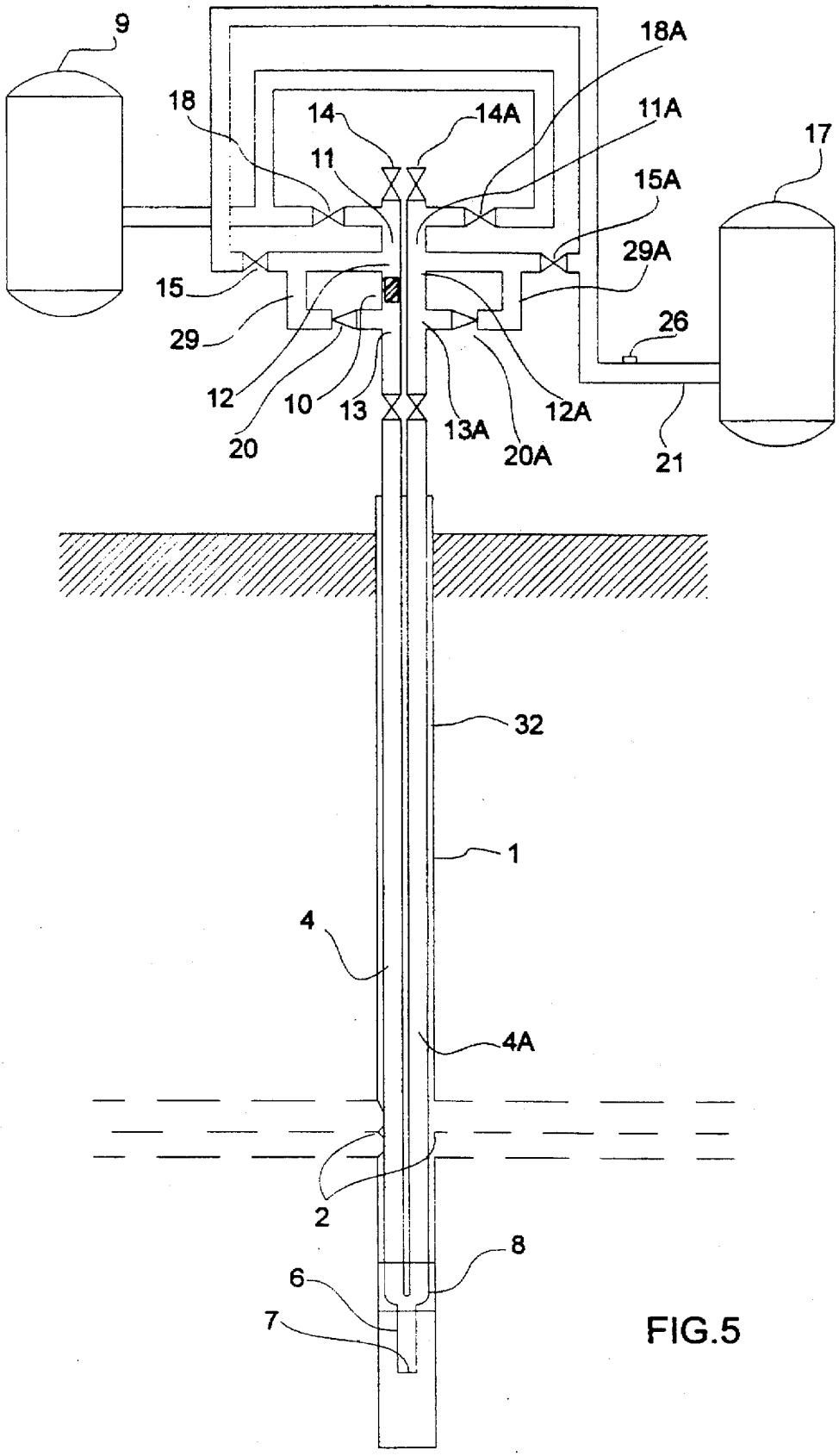
FIG. 5 is a schematic representation of the application of the method and of the apparatus which are the subjects of this invention in an oil well in which the lower end of production string is below the producing region

FIG. 4 shows the positioning of the equipment in a completed oil well without the utilization of the packer; and FIG. 5 shows the positioning of the equipment in an oil well, in which the producing region 2 is located above short production tubing (6), a location favouring the application of the method because it reduces the counterpressure in the producing region, inasmuch as the liquid phase is going to accumulate below It should be noted that the application of this invention is not impaired by the inclination of the well in relation to the vertical, not even in extreme situations, such as, for instance, in directional wells.

Different modes of the present invention have been presented aiming at demonstrating the versatility of its application. In all situations shown in the Figures. it can be seen that the basic distribution of the equipment used in the implementation of the method is the same. It is important to stress that all of them have a generic illustrative character and must in no way be regarded as limiting the invention.

For this invention to have a good performance it is fundamental that mechanical interface (10) be extremely flexible so as to be able to displace itself easily along strings and along surface equipment.

In this implementation the mechanical interface employed is made of low density polyurethane foam which due to its great flexibility is considered to be the most adequate material.

However, other materials can also be used, provided they have the desirable mechanical characteristics. Therefore, the utilization of low density polyurethane foam cannot be considered at all as limiting this invention.

I claim:

1. An apparatus for intermittent oil production using a mechanical interface, said apparatus comprising:

at least two production strings extending from a well head to a coupling disposed down a well adjacent a producing region, said coupling interconnecting said two production strings and a short production string which extends further down the well and which is provided with a check valve at a lower end thereof;

a gas source for supplying high pressure gas and a surge tank for receiving oil disposed adjacent said well head;

gas feeding valves connected between said gas source and said production string for selectively providing high pressure gas to either production string;

valve means for allowing introduction of at least one mechanical interface into launching/receiving devices connected to upper ends of said production strings, respectively;

bypass means connected between each production string at a point downstream of each launching/receiving device for equalizing upstream and downstream pressure when said mechanical interface passes said point;

check valves connected in said bypass means for permitting flow of gas through each bypass means only in one direction;

production valves disposed in production lines connected between said production strings and said surge tank for allowing flow of oil from said production strings to said surge tank; and a gas/liquid interface sensor means mounted on said production line leading to said surge tank for detecting when outflow to said surge tank is composed essentially of injected gas and for commanding closing of said gas feeding valves and opening of said production valves.

2. An apparatus according to claim 1, further including packing means mounted about said short production string above the producing region for sealing an annular space about said production strings.

3. An apparatus according to claim 1, wherein said producing region is located above said short production string.

4. An apparatus according to claim 1, further comprising a gas discharge line interconnecting said production line with an annular space in said well about said production strings, a discharge valve disposed in said gas discharge line and controlled by said gas/liquid interface sensor means for controlling discharge of gas flow into said annular space and a check valve in said production line for preventing reflux of oil from said surge tank into said annular space.

5. An apparatus according to claim 2, further comprising a gas discharge line interconnecting said production line with an annular space in said well about said production strings, a discharge valve disposed in said gas discharge line and controlled by said gas/liquid interface sensor means for controlling discharge of gas flow into said annular space and a check valve in said production line for preventing reflux of oil from said surge tank into said annular space.

6. An apparatus according to claim 3, further comprising a gas discharge line interconnecting said production line with an annular space in said well about said production strings, a discharge valve disposed in said gas discharge line and controlled by said gas/liquid interface sensor means for controlling discharge of gas flow into said annular space and a check valve in said production line for preventing reflux of oil from said surge tank into said annular space.

7. A method for intermittent oil production using a mechanical interface in a system including two production strings extending into a well and joined by a coupling at lower ends thereof to a short downwardly extending production string, two launching and receiving devices connected to upper ends of said production strings respectively, a high pressure gas source connected to said two launching/receiving devices by two gas feeding valves respectively, a surge tank connected to said two launching/receiving devices at a first point by two production lines having production control valves therein, a bypass having a check valve therein connected between each production line and each respective launching/receiving device at a second point downstream of said first point and a gas/liquid interface sensor mounted on the production line leading to said surge tank, said method comprising:

introducing said mechanical interface into one of said two launching/receiving devices and positioning said mechanical interface between said first and second point;

opening said production valves while maintaining said gas feed valves closed to allow oil to accumulate in said production strings;

closing a respective one of said production valves and opening a respective one of said gas feed valves after a predetermined period thereby applying high pressure gas from said source to push said mechanical interface down one of said production strings, through said coupling and up the other production string thereby displacing oil from said production strings to said surge tank, interrupting upward movement of said mechanical interface after passage through said second point of said launching/receiving device to allow gas to flow through the respective bypass to cause equalization of upstream and downstream pressures on the mechanical interface located between said first and second points;

using said sensor to detect exact moment at which flow to said surge tank is comprised essentially of injected gas to command closing of the respective gas feed valve that was opened at the beginning of the operation thereby interrupting gas flow; and using said sensor to command opening of the respective production valve that was closed at the initial phase of the operation to make possible initiation of a new cycle with movement of said mechanical interface through said production strings in an opposite direction.

8. A method as set forth in claim 7 further comprising using said sensor to control the gas discharge control valve installed on a gas discharge line so that gas present in said production strings and in the gas discharge line at the end of a passage of the mechanical interface is discharged into an annular space surrounding said production strings and providing a check valve to prevent oil from flowing back from said surge tank into the annular space.

* * * * *